US005993745A

United States Patent [19]

Laska

[11] Patent Number: 5,993,745

[45] Date of Patent: Nov. 30, 1999

[54] ARCHIVAL STORAGE TRAY FOR MULTIPLE TEST TUBES

[75] Inventor: Paul F. Laska, Carmel, Ind.

[73] Assignee: Roche Diagnostics Corporation, Indianapolis, Ind.

[21] Appl. No.: 09/035,111

[22] Filed: Mar. 4, 1998

[51] Int. Cl.[6] ..... A47B 73/00

[52] U.S. Cl. ..... 422/104; 206/446; 206/562; 211/74

[58] Field of Search ..... 422/104; 211/74; 206/443, 446, 562

[56] References Cited

U.S. PATENT DOCUMENTS

| | | | |
|---|---|---|---|
| Re. 30,276 | 5/1980 | Rohde . | |
| D. 290,401 | 6/1987 | Björkman . | |
| 3,643,812 | 2/1972 | Mander et al. | 206/443 X |
| 3,709,429 | 1/1973 | McKenzie et al. . | |
| 3,871,832 | 3/1975 | Lejlanc . | |
| 3,905,772 | 9/1975 | Hartnett . | |
| 4,000,976 | 1/1977 | Kramer et al. . | |
| 4,055,396 | 10/1977 | Meyer et al. . | |
| 4,069,798 | 1/1978 | Rohde . | |
| 4,076,170 | 2/1978 | Chulay et al. . | |
| 4,080,175 | 3/1978 | Chulay et al. . | |
| 4,124,122 | 11/1978 | Emmitt | 211/74 |
| 4,160,803 | 7/1979 | Potts | 422/104 X |
| 4,238,452 | 12/1980 | McMorrow . | |
| 4,434,890 | 3/1984 | Sieck et al. | 206/443 |
| 4,438,068 | 3/1984 | Forrest . | |
| 4,495,150 | 1/1985 | Cook et al. | 422/104 X |
| 4,522,089 | 6/1985 | Alvi . | |
| 4,539,842 | 9/1985 | McMollum et al. . | |
| 4,588,095 | 5/1986 | Mehra | 211/74 |
| 4,747,693 | 5/1988 | Kahl | 211/74 X |
| 4,770,381 | 9/1988 | Gold . | |
| 4,832,842 | 5/1989 | Limb | 206/562 X |
| 4,963,493 | 10/1990 | Daftsios . | |
| 5,080,232 | 1/1992 | Leoncavallo . | |
| 5,169,603 | 12/1992 | Landsberger . | |
| 5,350,564 | 9/1994 | Mazza et al. . | |
| 5,366,088 | 11/1994 | Hill et al. | 206/562 X |
| 5,456,360 | 10/1995 | Griffin | 206/443 |
| 5,579,929 | 12/1996 | Schwartz | 211/74 |
| 5,642,816 | 7/1997 | Kelly et al. | 211/74 X |

FOREIGN PATENT DOCUMENTS

| | | |
|---|---|---|
| 950703 | 7/1974 | Canada . |
| 0142284 B1 | 6/1985 | European Pat. Off. . |
| 0339143 A1 | 11/1989 | European Pat. Off. . |
| 0487493 B1 | 11/1991 | European Pat. Off. . |
| 833867 | 3/1952 | Germany . |
| 75832 | 9/1970 | Germany . |
| K08-91487 | 6/1996 | Japan . |
| 2005699 | 11/1987 | Spain . |
| 1095429 | 12/1967 | United Kingdom . |
| 1374732 | 11/1974 | United Kingdom . |
| WO 85/05039 | 11/1985 | WIPO . |
| WO 96/27442 | 9/1996 | WIPO . |

*Primary Examiner*—Chris K. Moore
*Attorney, Agent, or Firm*—Morrison & Foerster, LLP

[57] ABSTRACT

A test tube storage tray assembly with multiple storage bays for individual test tubes is disclosed. The storage tray assembly comprises three sections: a base section, a center section and a cover section. Each storage bay centers a test tube stored at two levels: at the base section and at the center section. The base section and the center section are connected by interlocking rims. The cover section may have a hermetically sealing rim interface with the center section. The test tube storage tray assembly is dimensioned for use in combination with automatic test tube handlers.

42 Claims, 6 Drawing Sheets

ARCHIVAL STORAGE TRAY FOR MULTIPLE TEST TUBES

FIELD OF THE INVENTION

The present invention relates to a storage tray assembly for storage of test tubes. Specifically, the present invention relates to a storage tray assembly for safely storing test tubes of different sizes and adapted for use in combination with automatic test tube handlers.

BACKGROUND OF THE INVENTION

In chemical, medical and biological applications, the handling of open or closed test tubes generally includes two phases: manipulation of test tubes during examination of their contents and permanent or temporary storage of test tubes. During examination, test tubes are held in holders for one or more test tubes, whereby groups of test tube holders may be assembled on separate trays for automatic processing. Such holders are designed for particular automatic test tube handlers and include features that are not needed for temporary or permanent storage of test tubes. Thus, using such test tube holders during a storage phase is both expensive and often space consuming.

Further, test tube storage trays must not damage any of the test tubes, their contents or the identification labels attached to each test tube. Such damage would cause the contents of the test tubes to be unusable and/or unidentifiable.

In addition, if the test tube labels are to be stored in a specific orientation, for example for use in an automatic test tube handler, the orientation of the test tubes should not change during insertion and storage.

Furthermore, for cost and space efficiency purposes, it may also be desirable to store test tubes of varying heights and diameters in the same test tube carrier or storage tray, and/or to stack multiple test tube carriers in a stable fashion.

SUMMARY OF THE INVENTION

The test tube storage tray assembly of the present invention is designed for use in combination with automatic test tube handlers and provides for safe storage of test tubes of varying heights and diameters.

The test tube storage tray assembly of the present invention comprises a base section, a center section and a cover section. The base section and the center section are subdivided to define storage bays, each for storing an individual test tube. The base section defines a recess for each storage bay for centering the lower end of the test tube. In addition, the center section defines a storage bay opening and includes a guide, comprising, for example, holding fingers, for each storage bay for guiding the test tube during insertion and for gripping the test tube during storage. The guide facilitate centering a middle portion of the test tube in the respective storage bay. Thus, each storage bay, extending between a centering recess defined by the bottom section and the storage bay opening and the guide of the center section, facilitates in guiding, holding and centering each test tube during insertion, storage and removal operations.

The guide is made of an elastic material in such a way as to reduce friction between the guide and the test tube during loading and unloading thereof from a storage bay of the storage tray assembly, thereby reducing or eliminating the possibility of damaging, smearing or scratching any labels attached to the test tube. During transportation of the storage tray assembly, the guide sufficiently grips or clamps a stored test tube to minimize or reduce the risk of rotation by the test tube due to ordinary vibration or handling. This ensures that a test tube inserted with the attached label at a desired orientation will maintain that orientation.

The shape and form of the base section and the center section conform with requirements of automatic test tube handlers for supplying test tubes for examination of their contents by the analyzing equipment and for receiving examined test tubes from the analyzing equipment. Thus, the storage tray assembly may be utilized during the storage phase of one or more test tubes and during the examination phase, in which test tubes are removed from the storage tray assembly and may later be restored therein.

The base section preferably further includes an indicator identifying the desired orientation of the storage tray assembly. This is of importance particularly when using the tray assembly in combination with automatic handlers. Such an indicator may be the location of a bar code marker attached to the storage tray, a deviation from the otherwise symmetrical shape of the storage tray, or a difference in the shapes and/or sizes of the two handles disposed on the base section of the tray assembly (as shown in FIG. 2). Additionally or alternatively, the spacing between the rows of the storage bays may be different from the spacing between the columns in order to reduce the possibility of misorientation of the storage tray during test tube placement or removal.

Although the storage tray assembly is disclosed with storage bays being arranged in rows and columns, it is within the scope of this invention to arrange storage bays in any suitable arrangement, such as in spiral or circular arrangements. The arrangement of the storage bays may be chosen to render the storage tray assembly compatible with an automatic test tube handler.

The components of the storage tray assembly are preferably manufactured from a material which is shock resistant and does not release gases which may contaminate the samples in stored test tubes. The material may be one that is useable in a cost efficient thermo forming manufacturing process. One substance useable for manufacturing storage tray components is polyethylene glycol terephthalate (PETG). Depending upon the application, the storage tray components may also protect the samples stored in the test tubes from light or a certain light spectrum. In such an application the material from which components of the storage tray are made have optical filter characteristics to protect the samples from, for example, ultraviolet (UV) light. Adding certain filler material to the polyethylene glycol terephthalate (PETG), making it nontransparent, may already satisfy the light-blocking requirement for a particular type of specimens.

Each of the base, center and cover sections provides a rim for aligning and interlocking of the sections. The rim of the base section encloses the rim of the center section to interlock the base and the center sections. The rim of the center section defines a U-shaped recess into which the rim of the cover section fits to interlock the center and the cover sections. The interlocking rims of the center and the cover sections provide a hermetic seal to thereby prevent an exchange of vapors and/or other contaminants between the external environment and the covered storage tray assembly during storage and/or handling of the test tubes. A gasket may also be disposed between the rims of the center and the cover sections to improve the hermetic seal therebetween. The cover section of the storage tray assembly may be designed for stacking multiple storage tray assemblies.

The design of the various sections of the storage tray assembly allows for ease of manufacturability from sheets of raw material using conventional thermo-forming methods.

DETAILED DESCRIPTION OF THE INVENTION

Figure 1B:
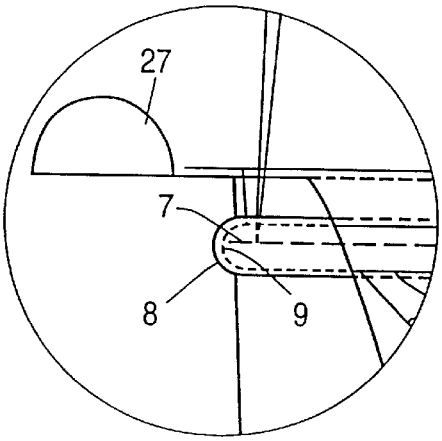
FIG. 1B is an enlarged cross-sectional illustration of the interlocking rims of the test tube storage tray assembly sections of the present invention.

FIG. 1 is an illustration of a tray assembly 1 for storing test tubes comprising a base section 2, a center section 3, and a cover section 4, wherein base section 2 may be aligned and interlocked with center section 3 and center section 3 may be interlocked with cover section 4.

Figure 1A:
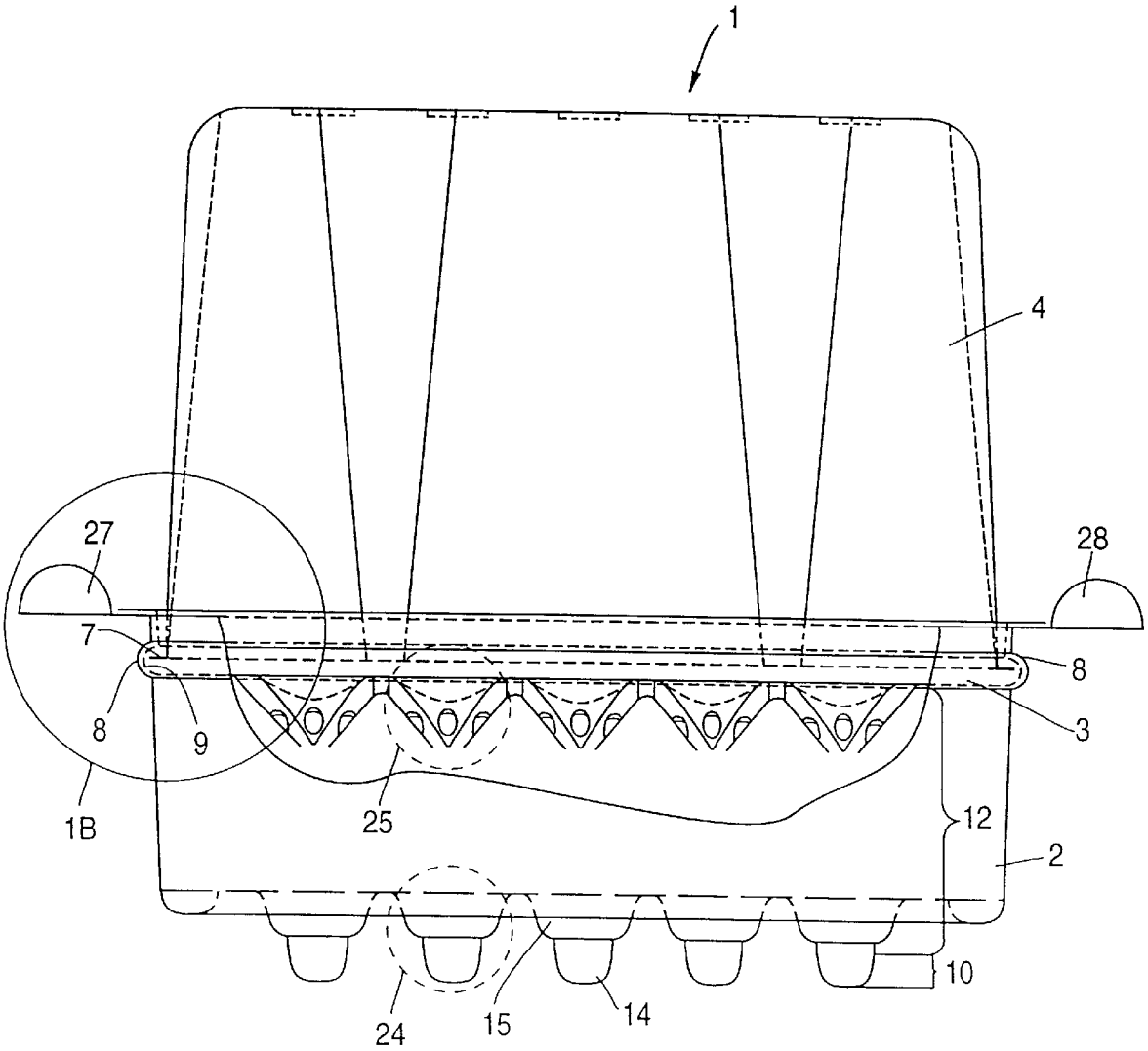
FIG. 1A is a partial cross-sectional illustration of a test tube storage tray assembly of the present invention.
Figure 3A:
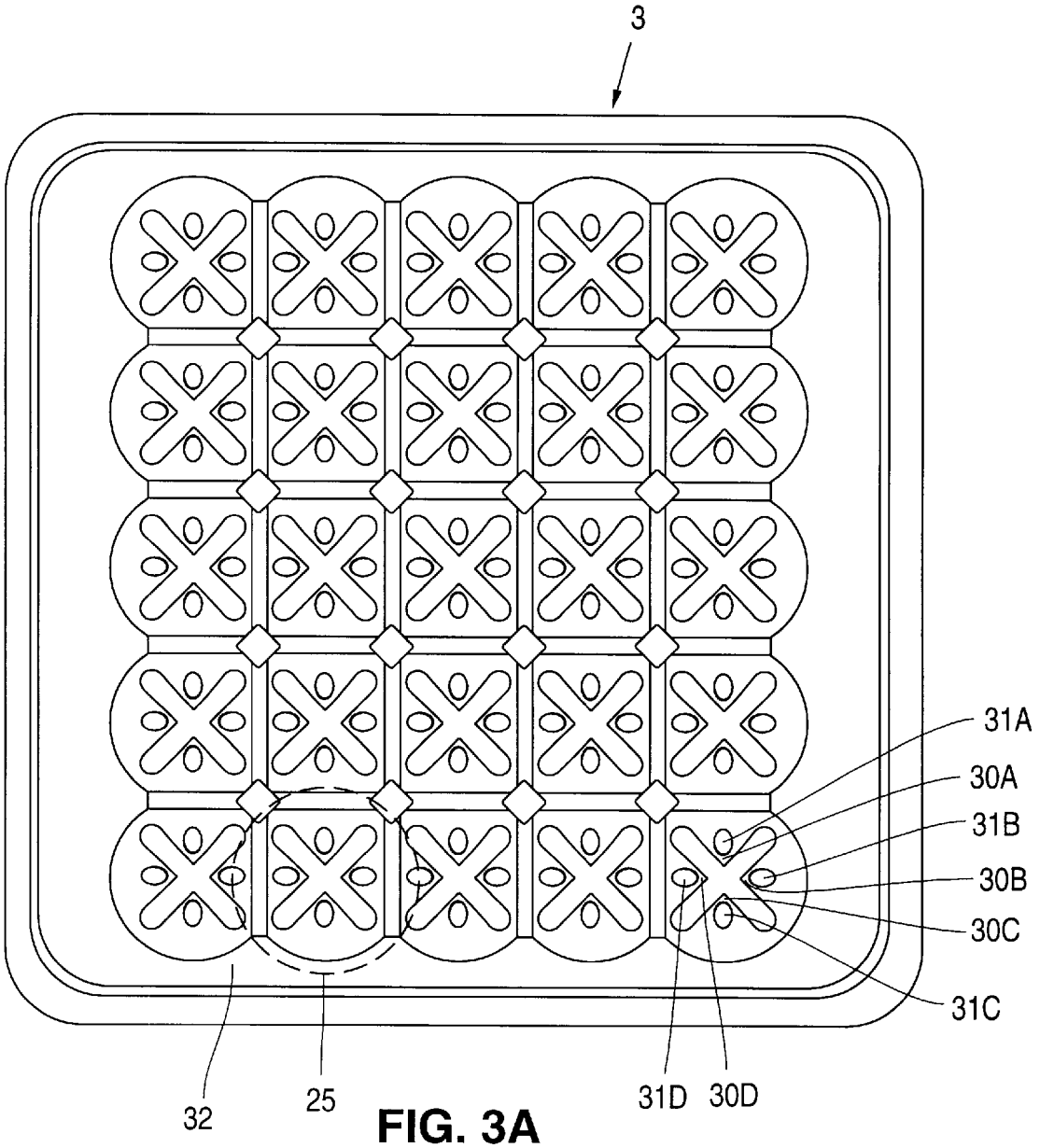
FIGS. 3A and 3B are, respectively, top and side illustrations of the center section of the test tube storage tray assembly of the present invention.
Figure 3B:
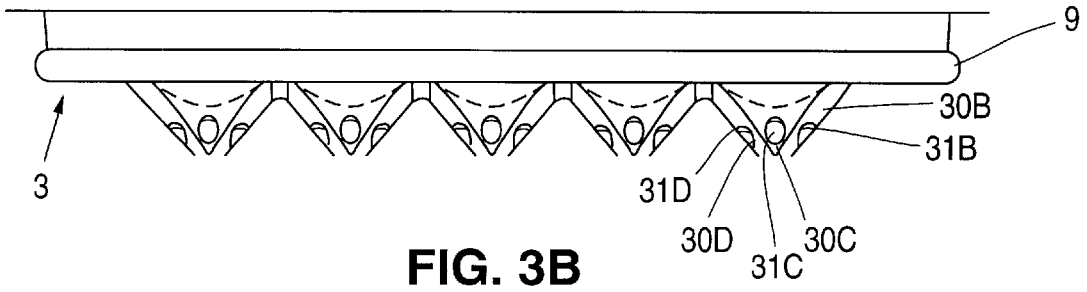
Figure 5:
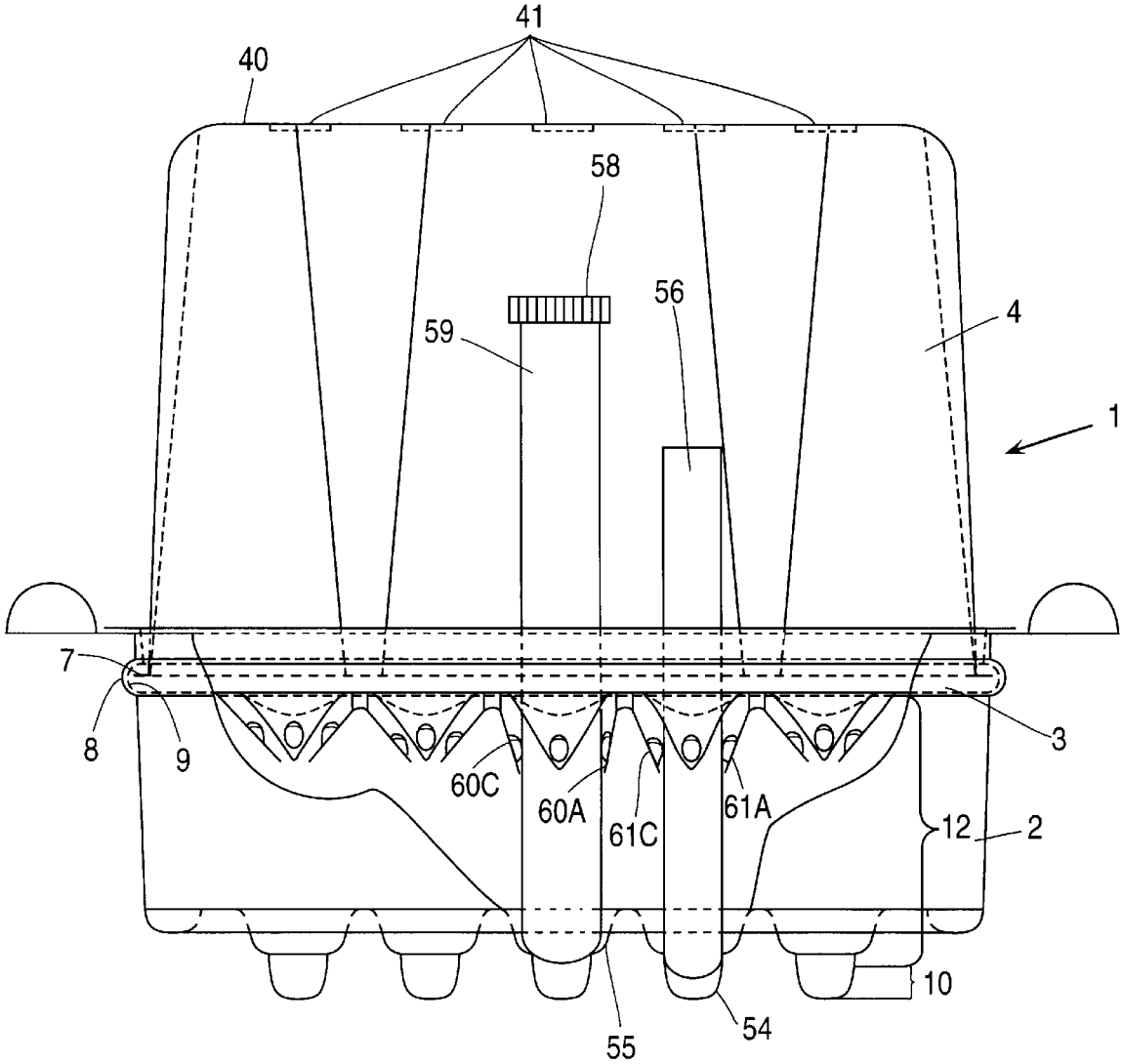
FIG. 5 is an illustration of two test tubes of different sizes in storage bays of the test tube storage tray assembly of the present invention.

To store the test tubes in tray assembly 1, an assembly of bottom section 2 and center section 3 provides a plurality of storage bays for holding the test tubes. Each storage bay is defined by one of a plurality of storage bay openings 25 (one of which is referenced in FIG. 1A) defined by center section 3 and by one of a plurality of centering recesses 24 (one of which is referenced in FIG. 1A) defined by bottom section 2. Storage bay openings 25 and centering recesses 24 are vertically aligned to facilitate in vertically aligning the stored test tubes. Each test tube is held by a storage bay at two levels. At one level, the bottom of each stored test tube rests in a centering recess 24 for centering the stored test tube in its vertical alignment. At another level, a middle portion of each test tube rests in a storage bay opening 25 and is gripped by a guide (for example, as shown in FIGS. 3A and 3B at reference number 30) provided by center section 3. Guide 30 may comprise any suitable test tube guiding and gripping mechanism such as a diaphragm with a central cross-cut or a plurality of guiding fingers 30A–30D (FIGS. 3A and 3B). As shown in FIGS. 1A and 5, spacing 12 defines the clamping height for test tubes in a storage bay.

The assembly and interlocking of base section 2 with center section 3 and center section 3 with cover section 4 will now be described. Cover section 4 includes a rim 7 which fits into a recess of rim 9 of center section 3. Center section rim 9 in turn fits into and is enclosed by rim 8 of base section 2.

To assemble base section 2 and center section 3, center section rim 9 is pressed into the inside of base section rim 8, to thereby provide a secure linkage between base section 2 and center section 3 (see FIG. 1A). Once base section 2 and center section 3 are assembled to form a storage tray, they may remain interlocked by their rims 8, 9 until discarded.

To assemble cover section 4 with the assembly of base section 2 and center section 3, cover section rim 7 fits snugly into a U-shaped recess of center section rim 9. In one embodiment, the placement of cover section rim 7 in the U-shaped recess of center section rim 9 provides a hermetic seal for the storage tray assembly 1. Cover section 4 may be manually or automatically placed upon and/or removed from the assembly of base section 2 and center section 3 for access to the stored test tubes.

The hermetic seal formed by cover section rim 7 and U-shaped recess of center section rim 9 minimizes or prevents contamination of the contents of the test tubes by the external environment. In addition, the hermetic seal prevents contamination of the external environment by the contents of the test tubes. For example, the test tubes may be stored with or without caps (see FIG. 5, for example, showing a stored test tube 59 with cap 58 and a test tube 56 without a cap). Thus, even if the test tubes were stored without caps, the hermetic seal prevents an exchange of vapors and/or other contaminates, such as the contents of test tubes spilled inside the enclosed storage tray assembly 1, from contaminating the external environment during storage and/or handling of the test tubes.

In the following description, storage tray assembly 1 and its components are shown to have 25 storage bays for storing test tubes in five columns and five rows. However, other arrangements can be made to accommodate different test tube handlers and storage racks without departing from the spirit of this invention. Furthermore, several storage trays, i.e. assemblies of bottom sections and center sections, can be adapted to be interlocked to form a larger, linked storage tray having a common cover section. Alternatively, several storage tray assemblies 1 comprising a bottom section 2, center section 3 and a cover section 4 may be stacked. In such a stacked multiple-assemblies configuration, the cover section 4 preferably has additional stiffening structures in the walls or bulkhead dividers inside the cover cavity to provide for sufficient support for stacking storage trays on top of the cover section.

Figure 2:
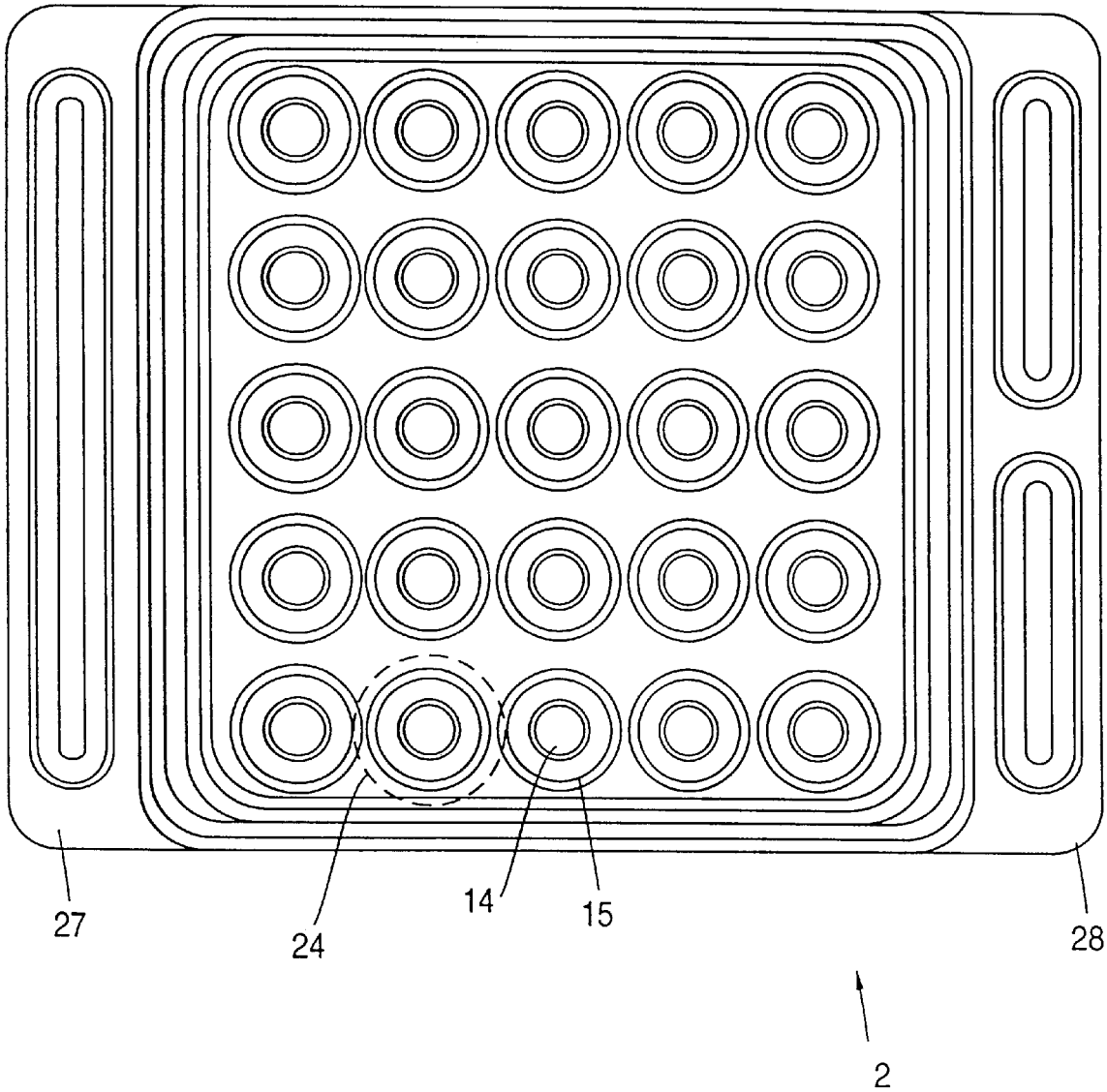
FIG. 2 is a top view illustration of the base section of the test tube storage tray assembly.

FIG. 2 is a top view illustration of base section 2 of tray assembly 1 for storing test tubes. As described above, base section 2 provides a centering recess 24 for each storage bay for storing a test tube. Centering recess 24 is adapted to receive and center the bottom of a test tube.

Preferably, centering recess 24 provides dual levels of recesses to facilitate receiving test tubes of different diameters and bottoms. Centering recess 24 preferably comprises small diameter recess 14 and large diameter recess 15. Small diameter recess 14 may be dimensioned to center a test tube with a relatively small diameter, for example, a test tube with a diameter of approximately 10 millimeters. Large diameter recess 15 may be dimensioned to center a test tube with a relatively large diameter, for example, a test tube with a diameter of approximately 10 millimeters to 16 millimeters.

Small diameter recess 14 preferably has a diameter smaller than the diameter of the smallest test tube to be stored. Such dimensioning of small diameter recess 14 ensures that, even when storing the smallest test tube, a vertical offset or spacing 10 (as shown in FIG. 1A and 5) is provided between the bottom of the stored test tube and the support surface on which the bottom section 2 rests. In addition, spacing 10 allows for automatic detection of the absence of storage tray bottom section 2 when the automatic test tube handler has the capability to sense the level to which a test tube is lowered. For example, when the automatic test tube handler attempts to insert a test tube, regardless of its diameter, into a storage bay when storage tray bottom section 2 is not present, the handler senses that the test tube can be lowered beyond the predetermined minimum offset 10. Thus, when the handler recognizes the absence of a storage tray bottom section 2, the handler will not release the test tube and spillage is avoided.

Alternatively, each centering recess 24 may have only one recess or may have more than two levels of recesses. The selection of the number and sizes of each centering recess 24 may be determined from factors such as the range of the diameters of the test tubes to be stored.

The ability of each recess 24 of base section 2 to position the bottom of a test tube in a predetermined position combined with the ability of the center section 3 to position the middle portion of each test tube eliminates the need for a three-level test tube supporting structure found in nearly all conventional test tube racks.

As shown in FIG. 2, base section 2 may optionally provide handles 27 and 28 for the convenience of an operator. By providing position and/or physical differences between handles 27 and 28, such as by providing handle 27 with one opening and handle 28 with two openings, handles 27 and 28 may also utilized as indicators to identify the desired orientation of base section 2. Providing indicators enables automatic handling of test tubes to load, store, and unload test tubes from storage tray assembly 1, and also enables selection of stored test tubes from an opened storage tray assembly 1 for examination of the contents of test tubes.

Any other suitable indicators may alternatively or additionally be utilized, such as the location of a bar code marker, a deviation from an otherwise symmetrical shape. Such indicators may be provided on base section 2 or center section 3 of storage tray assembly 1.

FIGS. 3A and 3B are illustrations of a top and side view, respectively, of center section 3 of tray assembly 1 for storing test tubes. Test tube guide plate 32 defines the area of storage bays and is encircled by center section rim 9. For each storage bay of test tube guide plate 32, guide 30 preferably provides four fingers 30A–30D. As test tubes are inserted from above guide plate 32, fingers 30A–30D point downwardly toward base section 2.

Each of fingers 30A–30D preferably has a rounded shape (not shown) so as to prevent or minimize the edges of fingers 30A–30D from scratching a test tube label during insertion and removal of the test tube. Alternatively, each of finger 30A–30D has a pointed corner (as shown in FIG. 2). Where fingers 30A–30D have pointed corners, fingers 30A–30D preferably include protrusions 31A–31D, respectively, to prevent fingers 30A–30D from scratching a test tube label during insertion and removal of the test tube. Protrusions 31A–31D are preferably positioned such that they are the only parts of fingers 30A–30D which contact a test tube, whether a small diameter or large diameter test tube.

Fingers 30A–30D and protrusions 31A–31D are preferably made of a smooth elastic material to minimize the force needed for loading, retaining and unloading a test tube from a storage bay of the storage tray assembly 1, thereby reducing or eliminating the possibility of damaging, smearing or scratching any labels attached to the test tube. The danger of damaging a label attached to the test tube is also reduced by the rounded shape of protrusions 31A–31D and/or the rounded shape of fingers 30A–30D.

At the same time, the force exerted on the test tube by fingers 30A–30D and protrusions 31A–31D is preferably sufficient to minimize or reduce the risk of rotation of the test tube due to ordinary vibration or handling. Minimizing or reducing rotation of the test tube ensures that the orientation of the stored test tube is maintained even during transportation of the storage tray assembly 1. Thus, if a test tube is stored in a storage bay at a desired orientation, such as an orientation dictated by a label reading sensor, the test tube and its label would remain at that desired orientation.

Fingers 30A–30D are disposed below the top plane of guide plate 32 and thus facilitate in guiding a test tube into its respective storage bay. In addition, the elasticity of fingers 30A–30D function to center a test tube into its respective storage bay and thereby allow a test tube to be inserted at an angle deviating from the desired insertion and storage angle, such as normal to guide plate 32. Alternatively, the test tube may be generally vertically inserted and retained by fingers 30A–30D at a non-perpendicular angle relative to the guide plate 32. In that case, fingers 30A–30D function to direct the tube into the desired insertion and storage angle. Thus, fingers 30A–30D have the capability to guide the test tube during insertion and center the test tube after it is released by, for example, from a handler. The guiding and centering functions of fingers 30A–30D allow for a more relaxed accuracy and precision requirements of an automatic insertion device.

As shown in FIGS. 3A and 3B, fingers 30A–30D are oriented such that they are parallel to the sides of test tube guide plate 32. The orientation, dimension, shape and number of fingers and protrusions as well as the force of the fingers and their protrusions exerted on a test tube during their insertion, storage and removal may be determined by factors related to the manufacturing process as well as application requirements. For example, it may be advantageous to arrange the fingers at a 45° angle relative to the sides of guide plate 32. Alternatively, it may be advantageous to utilize a three finger-three protrusion arrangement for centering the test tubes during insertion, storage and removal. Further, fingers 30A–30D of center section 3 may be designed and fabricated so as to retain filled and stoppered test tubes even when the entire assembly 1 is inverted.

Guide plate 32 may also provide row and column labels or absolute test tube position labels (not shown) for each storage bay opening 25 to thereby eliminate the need for a secondary labeling operation. The labels may be raised or indented and may be formed using common thermo forming techniques.

Figure 4A:
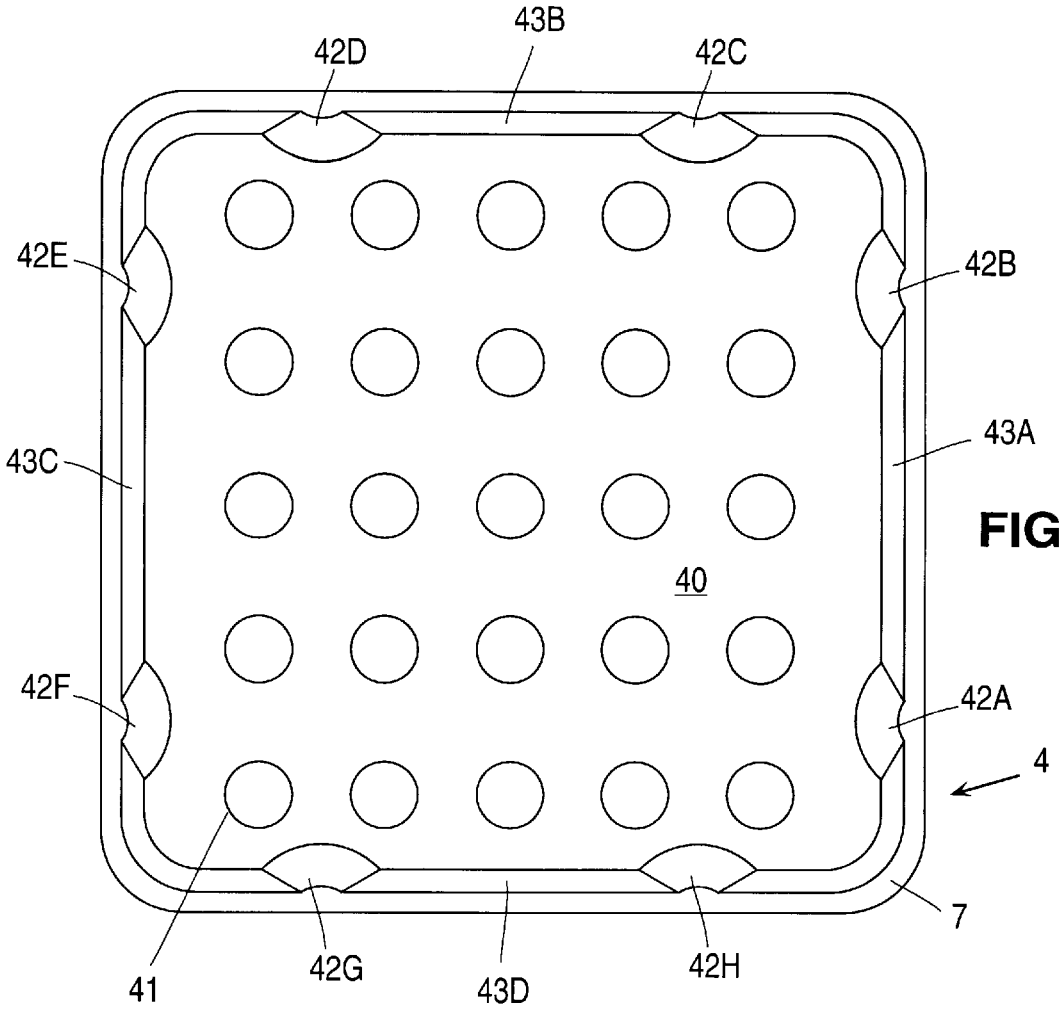
FIGS. 4A and 4B are, respectively, top and side illustrations of the cover section of the test tube storage tray assembly of the present invention.
Figure 4B:
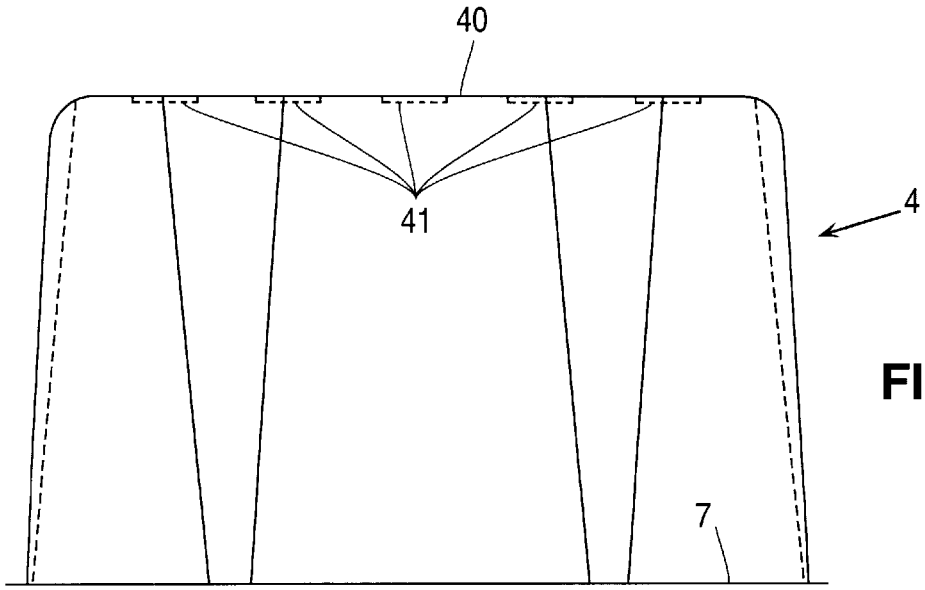

FIGS. 4A and 4B are, respectively, top and side illustrations of the cover section 4 of tray assembly for storing test tubes. Cover section 4 includes top plane 40 defining recesses 41. One recess 41 is provided for each of the storage bays in the storage tray comprising base section 2 and center section 3. Recesses 41 are used for aligning stacked storage tray assemblies 1 by mating with the exterior surfaces of recesses 14 (see FIG. 1A) of base section 2 of a storage tray placed on top of cover section 4. Alternatively, multiple storage trays comprising base section 2 and center section 3 may be stacked to form a larger, stacked storage tray having a common cover section 4. In either embodiment, providing different spacings between the rows and the columns of the storage bays may facilitate in reducing the possibility of misorientation of the storage trays during stacking. The depth and diameter of recesses 41 are controlled/dimensioned to provide the desired stability of the stacked assemblies 1.

To improve rigidity of cover section 4 where multiple storage tray assemblies 1 are stacked, the sides of cover section 4 optionally includes folds 42A–42H. Folds 42A–42H strengthen cover section 4 and enhance the ability to stack multiple storage tray assemblies 1.

FIG. 5 illustrates the capability of the test tube storage tray assembly 1 of the present invention to store test tubes of varying sizes. Narrow test tube 56 and wide test tube 59 are stored in storage bays of the storage tray assembly 1 of the present invention. Wide test tube 59 is shown having a cap 58. However, test tubes may be stored without caps. Narrow test tube 56 is centered at its lower end by narrow recess 54, whereas wide test tube 59 is centered at its lower end by wide recess 55. Holding fingers 60A–60D (only three fingers are shown) of the bay holding wide test tube 59 are bent near their maximal extent. Holding fingers 61A–61D (only three fingers are shown) of the storage bay holding narrow test tube 56 are bent only somewhat. However, in both cases, only the protrusions of fingers 60A–60D and 61A–61D contact test tubes 59 and 56, respectively. Test tubes 59 and 56 (representative for up to 25 test tubes) are held centered in their respective storage bays before cover section 4 is put in place.

Figure 6B:
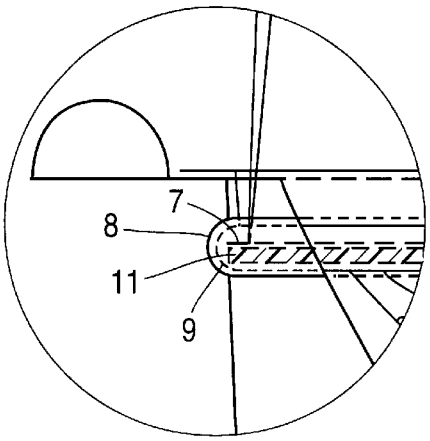
FIG. 6B is an enlarged cross-sectional illustration of the interlocking rims of the test tube tray assembly sections with a hermetic seal gasket.
Figure 6A:
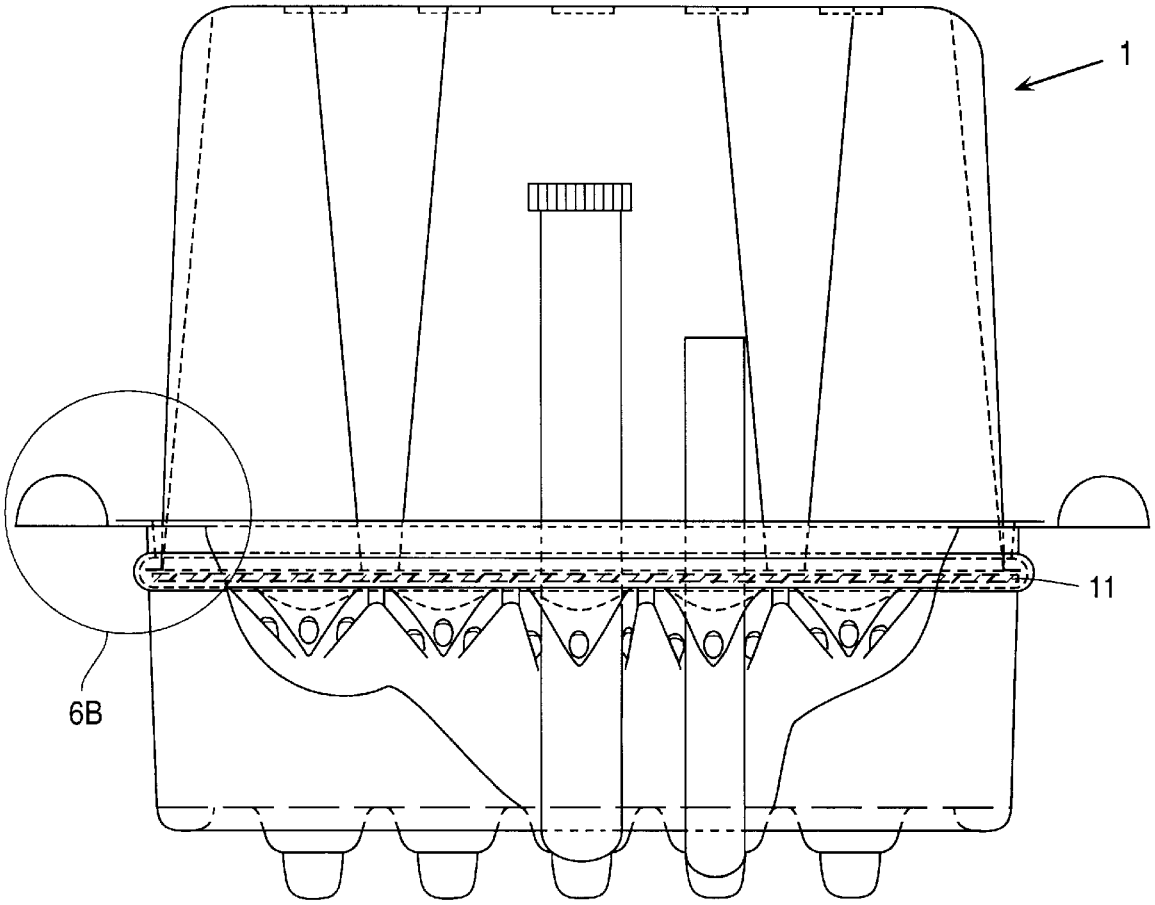
FIG. 6A is an illustration of the test tube storage tray assembly of the present invention including a gasket for improving the hermetic seal.

FIGS. 6A and 6B illustrate improvement of the hermetic seal of storage tray assembly 1 by inserting a gasket 11 between rim 7 of cover section 4 and test tube guide plate 32 next to rim 9 of center section 3. The hermetic seal can be maintained by an external force exerted on cover section 4 and base section 2. Such a force can be applied by any suitable methods such as by a clamp or by a slight vacuum generated inside tray assembly 1 (not shown). One of ordinary skill in the art has the knowledge to define a clamp or to provide the means to generate a vacuum inside the storage tray assembly 1. The hermetic seal may be manually or automatically enforced by utilizing a compressible gasket or o-ring.

Although various embodiments of the invention have been described, the descriptions are intended to be merely illustrative. Thus, it will be apparent to those skilled in the art that modifications may be made to the embodiments as described without departing from the scope of the claims set forth below.

What is claimed is:

1. A tray assembly for storing a plurality of test tubes, each test tube having a bottom, said tray assembly comprising:

a base section including a base rim and defining a plurality of recesses, each of said recesses being adapted for receiving the bottom of a test tube therein;

a center section defining a plurality of openings, each of said openings being adapted to receive a test tube therethrough, said center section providing a guide in each of said openings for guiding a test tube during insertion therethrough and for holding the test tube in position, said center section including a center rim for alignment with said base rim; and a cover section including a cover rim for alignment within said center rim.

2. The tray assembly of claim 1, wherein said center rim is recessed and said base rim interlocks with said center rim.

3. The tray assembly of claim 1, wherein said base section includes at least one indicator for defining orientation of said base section and said center section.

4. The tray assembly of claim 1, wherein one or more of said base section, said center section and said cover section are made from polyethylene glycol terephthalate.

5. The tray assembly of claim 1, wherein said tray assembly further includes a gasket between said cover rim and said center rim.

6. The tray assembly of claim 1, wherein one or more of said base section, said center section and said cover section are made from material having optical filtering characteristics.

7. The tray assembly of claim 1, wherein each of said guides includes a plurality of fingers approximately evenly arranged within each of said openings for centering the test tube in said opening.

8. The tray assembly of claim 7, wherein each of said fingers includes a protrusion directed towards a stored test tube, said protrusion has a surface adapted to prevent scratching the test tube during insertion and removal of the test tube.

9. The tray assembly of claim 7, wherein each of said guides includes three fingers.

10. The tray assembly of claim 7, wherein each of said guides includes four fingers.

11. The tray assembly of claim 10, wherein each of said four fingers is oriented approximately parallel to a side of said center rim.

12. The tray assembly of claim 10, wherein each of said four fingers is oriented at approximately 45° relative to a side of said center rim.

13. The tray assembly of claim 7, wherein said fingers are arranged below a plane defined by said center rim.

14. The tray assembly of claim 7, wherein each of said fingers includes a protrusion with a rounded surface adapted to contact an outside surface of a stored test tube and wherein said rounded surface of said protrusion prevents damaging of a label attached to the outside surface of the test tube.

15. The tray assembly of claim 1, wherein one or more of said base section, said center section and said cover section is manufactured using thermo forming methods.

16. The tray assembly of claim 1, wherein each of said recesses is adapted for centering the bottom of a test tube and includes a first recess having a diameter, the diameter being smaller than the diameter of the test tube for supporting the test tube at a height above the bottom surface of said base section.

17. The tray assembly of claim 1, wherein each of said recesses includes a first recess and a second recess, said first and second recesses adapted for centering a relatively larger diameter test tube and a relatively smaller diameter test tube, respectively.

18. The tray assembly of claim 17, wherein said second recess has a diameter smaller than the diameter of the smaller diameter test tube for supporting the bottom of the smaller diameter test tube at a height above the bottom surface of said base section.

19. The tray assembly of claim 1, wherein said openings are arranged in a plurality of rows and columns.

20. The tray assembly of claim 19, wherein said rows and columns are spaced differently.

21. The tray assembly of claim 1, wherein said openings are arranged in a circular pattern.

22. The tray assembly of claim 1, wherein said openings are arranged in a spiral pattern.

23. The tray assembly of claim 1, further comprising another said base section and another said center section, wherein said another base section is adapted to align with said center section and said another center section is adapted to align with said cover section to form a multiply stacked tray assembly.

24. The tray assembly of claim 1, further comprising another said base section, another said center section, and another said cover section, wherein said cover section is adapted to align with the exterior of said plurality of recesses of said another base section to form a multiply stacked tray assembly.

25. The tray assembly of claim 24, wherein each of said cover section and said another cover section includes a top plane and at least one supporting wall extending downwardly from said top plane to provide support for said top plane.

26. The tray assembly of claim 1, wherein said cover section includes a top plane and at least one wall extending downwardly from said top plane.

27. The tray assembly of claim 26, wherein said at least one wall of said cover section extends to said center section, wherein said at least one wall divides said plurality of openings into at least two groups.

28. A tray assembly for storing a plurality of test tubes, each test tube having a bottom, said tray assembly comprising:

a center section defining a plurality of openings, each of said openings being adapted for insertion of a test tube therethrough, said center section includes a member for guiding a test tube therethrough;

a base section releasably attachable to said center section, said base section defining a plurality of recesses vertically aligned with said plurality of openings, each of said recesses being adapted for centering the bottom of the inserted test tube; and a cover section alignable with said center section.

29. The tray assembly of claim 28, wherein said member comprises a plurality of flexible extensions extending into said opening, said extensions being approximately evenly disposed within each of said openings for guiding a test tube therethrough.

30. The tray assembly of claim 28, wherein said member comprises a plurality of flexible extensions extending into said opening, each of said extensions includes a protrusion adapted to contact the stored test tube and to prevent scratching the test tube during insertion and removal thereof.

31. The tray assembly of claim 28, wherein said member comprises a plurality of flexible extensions extending into said opening, each of said extensions includes a protrusion having a rounded surface and adapted to contact an exterior surface of the stored test tube, said rounded surface prevents damage to a label attached to the exterior surface of the test tube.

32. The tray assembly of claim 28, wherein said member comprises a plurality of flexible extensions extending into said opening, wherein each of said openings includes four extensions, each of said extensions being oriented approximately parallel to a side of said center section.

33. The tray assembly of claim 28, wherein said member comprises four flexible extensions extending into said opening, each of said extensions being oriented at approximately 45° relative to a side of said center section.

34. The tray assembly of claim 28, wherein one or more of said base section, said center section and said cover section is manufactured using thermo forming methods.

35. The tray assembly of claim 28, wherein each of said recesses includes a first recess having a first diameter smaller than the diameter of the test tube for supporting the test tube at a height above the bottom surface of said base section.

36. The tray assembly of claim 35, wherein each of said recesses further includes a second having a second diameter, said second diameter being larger than said first diameter.

37. The tray assembly of claim 28, wherein said openings are arranged in a plurality of rows and columns, said rows and columns are spaced differently.

38. The tray assembly of claim 28, wherein said openings are arranged in a pattern selected from the group consisting of a circular pattern, a spiral pattern and a plurality of rows and columns.

39. The tray assembly of claim 28, wherein said cover section is releasably attachable to said center section to form a hermetic seal therebetween.

40. The tray assembly of claim 28, further comprising another said base section and another said center section, wherein said another base section is adapted to be aligned with said center section and said another center section is adapted to be aligned with said cover section to form a multiply stacked tray assembly.

41. The tray assembly of claim 28, further comprising another said base section, another said center section, and another said cover section, wherein said cover section is adapted to align with the exterior of said plurality of recesses of said another base section to form a multiply stacked tray assembly.

42. The tray assembly of claim 41, wherein each of said cover section and said another cover section includes a top plane and at least one supporting wall extending downwardly from said top plane to provide support for said top plane.

* * * * *